United States Patent [19]

Longberg et al.

[11] Patent Number: 4,497,471

[45] Date of Patent: Feb. 5, 1985

[54] ASSEMBLY ON A CHAIN SHEAVE/CHAIN-ROPE SYSTEM

[75] Inventors: Leif Longberg, Landås; Håkon S. Pedersen, Hop, both of Norway

[73] Assignee: A/S Bergens Mekaniske Verksteder, Bergen, Norway

[21] Appl. No.: 517,502

[22] Filed: Jul. 25, 1983

[30] Foreign Application Priority Data

Aug. 3, 1982 [NO] Norway ..... 822658

[51] Int. Cl.[3] ..... B63B 21/14; B66D 1/30

[52] U.S. Cl. ..... 254/372; 254/382; 254/394; 254/403; 254/415; 114/179; 114/230

[58] Field of Search ..... 254/372, 382, 394, 403, 254/407, 411, 415, 134.3 SC; 226/196; 242/157 R; 114/293, 179, 230, 253, 254

[56] References Cited

U.S. PATENT DOCUMENTS

| | | | |
|---|---|---|---|
| 126,391 | 5/1872 | Hall et al. | 254/403 |
| 1,239,110 | 9/1917 | Knutson | 254/382 X |
| 1,458,354 | 6/1923 | Neller | 254/372 X |
| 3,048,369 | 8/1962 | Hanson | 254/415 |
| 3,912,228 | 10/1975 | Petty et al. | 114/230 |
| 3,985,093 | 10/1976 | Eidem | 114/230 X |
| 4,023,775 | 5/1977 | Beattie | 254/372 X |

FOREIGN PATENT DOCUMENTS

| | | | |
|---|---|---|---|
| 72893 | 6/1979 | Japan | 114/230 |
| 131848 | 5/1975 | Norway . | |
| 135743 | 2/1977 | Norway . | |
| 269725 | 11/1977 | U.S.S.R. | 114/293 |

*Primary Examiner*—Stuart S. Levy
*Assistant Examiner*—Joseph J. Hail, III
*Attorney, Agent, or Firm*—Young & Thompson

[57] ABSTRACT

In a chain sheave/chain-rope system wherein an end of a chain is connected to an end of a rope via a splice member, guide members are provided on the splice member for cooperation with guide members within a hawsehole that precedes the chain sheave. As a result of this cooperation, the splice member and the chain attached thereto are brought into the correct position for engagement prior to their entry onto the chain sheave.

5 Claims, 9 Drawing Figures

ASSEMBLY ON A CHAIN SHEAVE/CHAIN-ROPE SYSTEM

Figure 1:
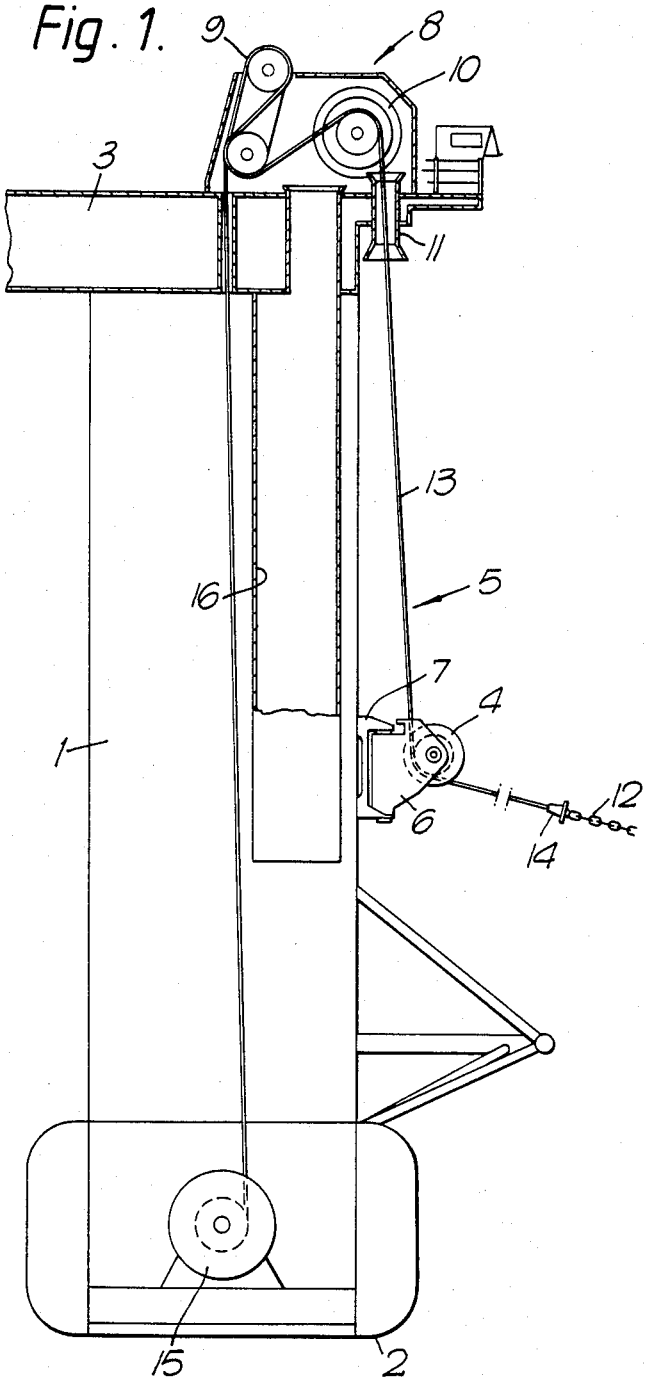

The invention relates to an assembly on a chain sheave/chain-rope system wherein one end of a chain is connected to one end of a rope via a splice member that is intended to lie within one of the recesses or pockets of the chain sheave while travelling over the sheave, the splice member comprising a sleeve socket for receiving the end of rope and half-link of chain from which the end link of the chain is suspended.

The invention has been developed in connection with a mooring system for floating drilling rigs or drilling platforms. Seagoing drilling rigs or platforms must be very securely anchored to prevent large lateral movements in relation to the drilling equipment and/or risers. The mooring systems most frequently used today consist of anchors which dig down into the sea bed, a length of chain leading away from each anchor, and a rope which forms a continuation of the chain and leads to a winch on board the platform. A mooring system of this type combines the advantages of a chain with the advantages of a rope, while avoiding the drawbacks associated with the use of either chain or rope alone.

In this type of mooring system, each anchor cable—consisting of a combination of rope and chain—passes over a guide sheave placed low down on the platform and travels up to a chain sheave leading further to a winch. The winch includes a drum for coiling up the rope, and the chain, after having travelled over the chain sheave which constitutes part of a chain winch, normally passes into a chain locker.

The connection between the rope and the chain has presented problems, because the splice member utilized must be formed such that it can travel over the guide sheave and chain sheave without subjecting the rope to sharp turns or bends. Several types of splice members, satisfactory per se, are known. Thus, the applicant has developed a mooring system with a splice member formed so as to prevent too much bend in the rope when passing over the guide sheave and chain sheave, and the splice member is also formed so as to be able to travel over the chain sheave lying within one of the pockets of the sheave. This solice member was developed early in 1973 and was sold as part of a complete chain/rope mooring system for the rig, "Ocean Ranger". A model of this mooring system, including the splice member, was also exhibited at the Oil Technology Conference in Houston, Tex., U.S.A., in May 1974.

The splice member comprises a sleeve socket for receiving an end of and a half-link of a chain, to which the end link of the chain is attached. Four protruding pins on the sleeve socket are intended to rest against the periphery or flange edges of the guide sheave, in pairs, to prevent too much bend in the rope. The splice member is also formed to permit its passage over a chain sheave with pockets, with one pair of pins being in contact with the flange edge of the chain sheave.

Norwegian patent No. 131,848 shows a splice member comprising an egg-shaped connector between the chain and the rope. To prevent bends in the rope, the rope is embedded within a sleeve that is pivotable via a universal coupling. This known device is relatively complicated, consisting of many parts, and is subject to corrosion and other factors.

Norwegian patent No. 135,743 shows a device comprising a bell-shaped member for splicing a chain and a rope. To prevent too much bend in the rope, the bell-shaped member is retained in a guide outside the groove for the rope and chain in the guide sheave, and the diameter of the guide sheave is thus relatively large. The splice member can pass over the guide sheave only at a very restricted angle of wrap. Another drawback is that the splice member is not adapted to pass over a chain sheave with pockets.

A drawback of all of the known embodiments is that they fail to provide for correct positioning of the half-link of chain and its connected chain end link in relation to the chain sheave. As mentioned above, the splice member is intended to lie in one of the chain sheave's pockets while travelling over the sheave. In the embodiment devised by applicant, the half-link of a chain in the splice member lies horizontally when passing the chain sheave and the end link of the chain is vertically disposed.

The object of the present invention is to ensure that the splice member is guided into the correct position in relation to the chain sheave so that the succeeding chain is automatically guided into correct engagement with the chain sheave pockets. In accordance with the invention, therefore, guides for the splice member are provided immediately preceding the chain sheave, so that the chain that follows, i.e., most importantly the end link of the chain, is brought into the correct position for engagement prior to its entry onto the chain sheave.

In accordance with the invention, a chain sheave-chain-rope system is provided wherein an end of a chain is connected to an end of a rope in a splice member which is intended to travel over the chain sheave while lying in one of the pockets of the sheave, said splice member comprising a sleeve socket for receiving the rope end and a half-link of the chain, to which the end link of the chain is attached, and the assembly of the invention is characterized by guide members on the splice member which cooperate with guide members in a hawsehole upstream of the chain sheave, whereby the end link of the chain is brought into the correct position for engagement prior to its entry onto the chain sheave.

The guide members on the splice member preferably comprise two diametrically opposed guide pins protruding outwardly from the splice member. In most cases the combined rope-chain will also have to pass over a guide sheave, and in such cases the splice member developed previously by applicant is preferably utilized. This member has four projecting pins spaced 90° apart around the sleeve socket, two diametrically opposed pins being disposed in the plane of the chain half-link, and during the passage of the splice member about the chain sheave, one pair of diametrically opposed pins will ride on the external flanges or periphery of the chain sheave while one pin in the second pair travels in the groove between the studs of the chain sheave. When such a splice member is utilized in conjunction with the assembly of the present invention, the assembly is characterized in that the pins in one of the pairs are longer than the pins in the other pair and the longer pins act as guide members.

As stated above, the guide members on the splice member cooperate with guide members in a hawsehole preceding the chain sheave. The term "hawsehole" as used in this connection means a suitable guidance device for the rope/chain, and a hawsehole for use in an assembly in accordance with the invention is characterized by guide members arranged within the hawsehole for cooperation with the guide members provided on the splice member, such that the end link of the chain attached to the half-link of the chain in the splice member is brought into the correct position for engagement prior to entering the chain sheave.

The guide members in the hawsehole are preferably in the form of two diametrically opposed grooves within the hawsehole opening, extending along the walls of the hawsehole in the direction of cable passage, with guide ramps provided leading up to the respective grooves.

The hawsehole is preferably tubular in shape, with a funnel-shaped guide at the inlet opening. With this type of hawsehole, the guide members are preferably formed by providing two diametrically opposed shell plates along the walls within the hawsehole, each shell plate having a symmetrically tapered leading edge toward the hawsehole inlet and two straight longitudinal edges, and each shell plate having an arc length smaller than a semicircle. To provide greater depth in the grooves formed between the pairs of opposing longitudinal edges on the respective shell plates, the shell plates are preferably spaced a distance away from the surrounding wall of the hawsehole and are connected to the wall by means of radially extending spokes.

The invention will be explained in greater detail in the following with reference to the accompanying drawings, wherein:

FIG. 1, in vertical projection, shows a platform leg with a guide sheave and a chain sheave for a mooring cable.

Figure 2:
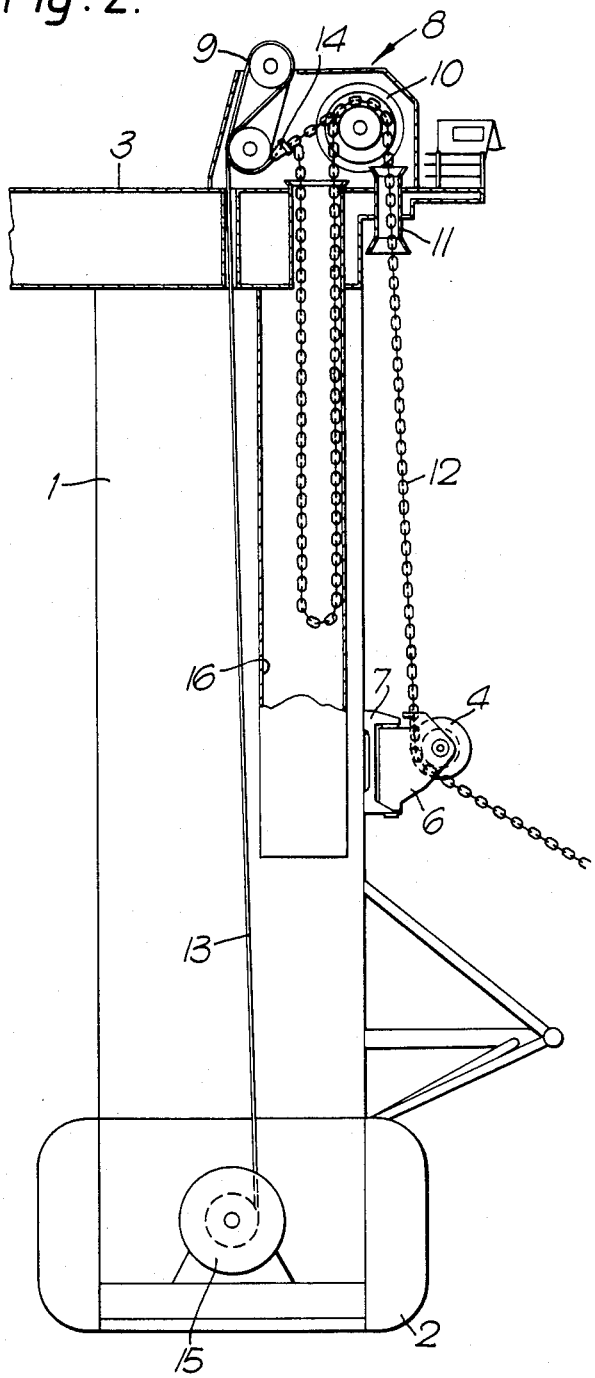
Figure 3:
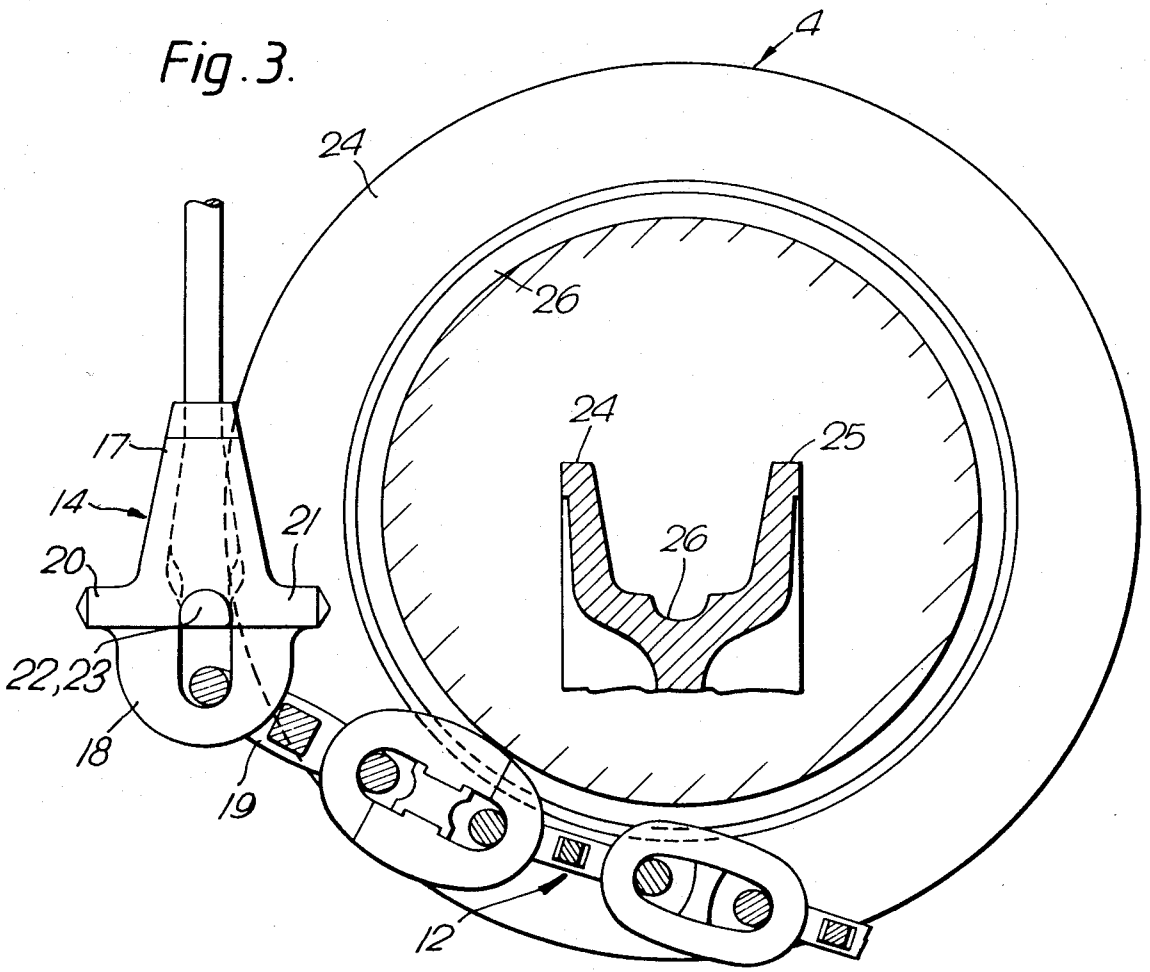
Figure 4:
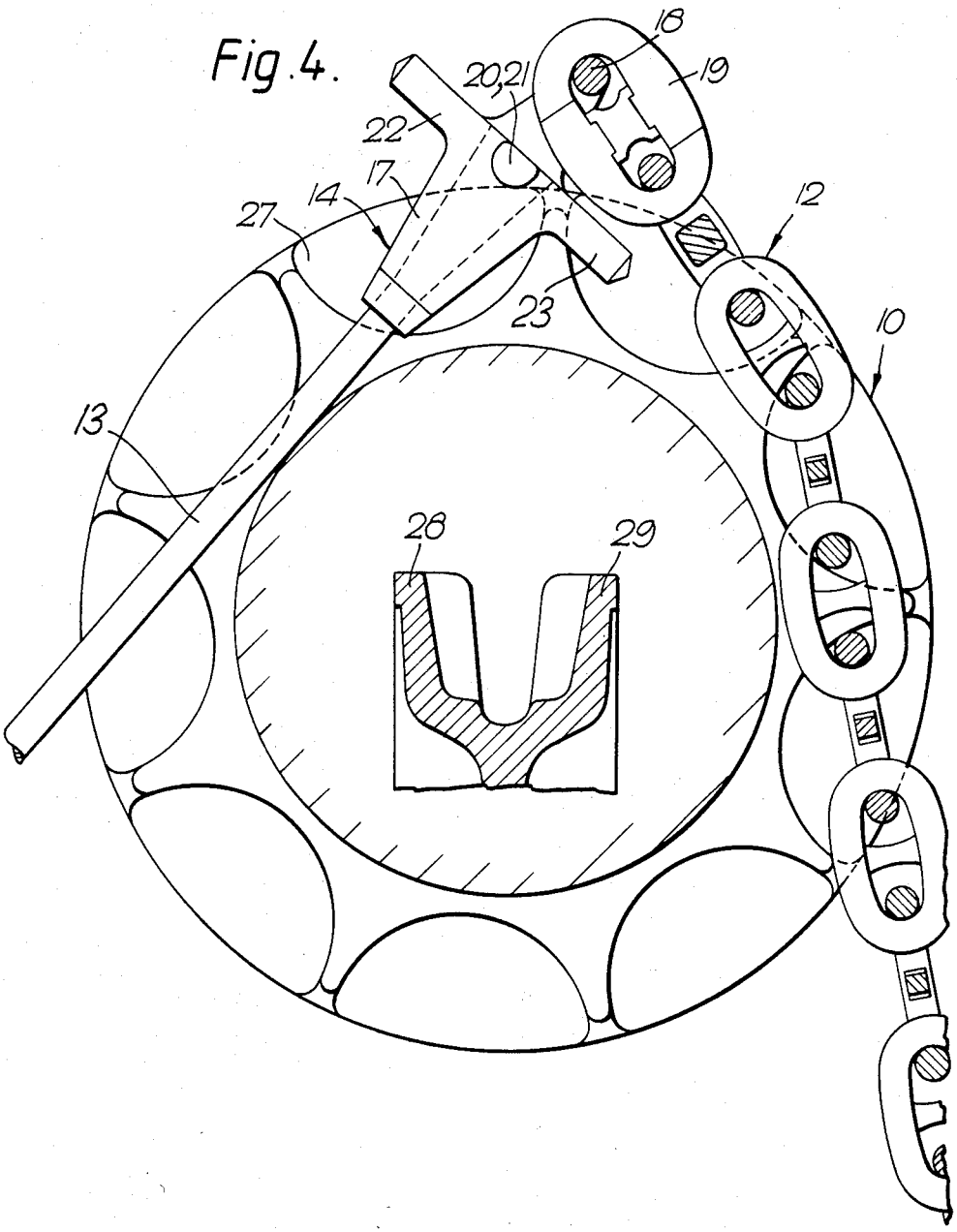
Figure 5:
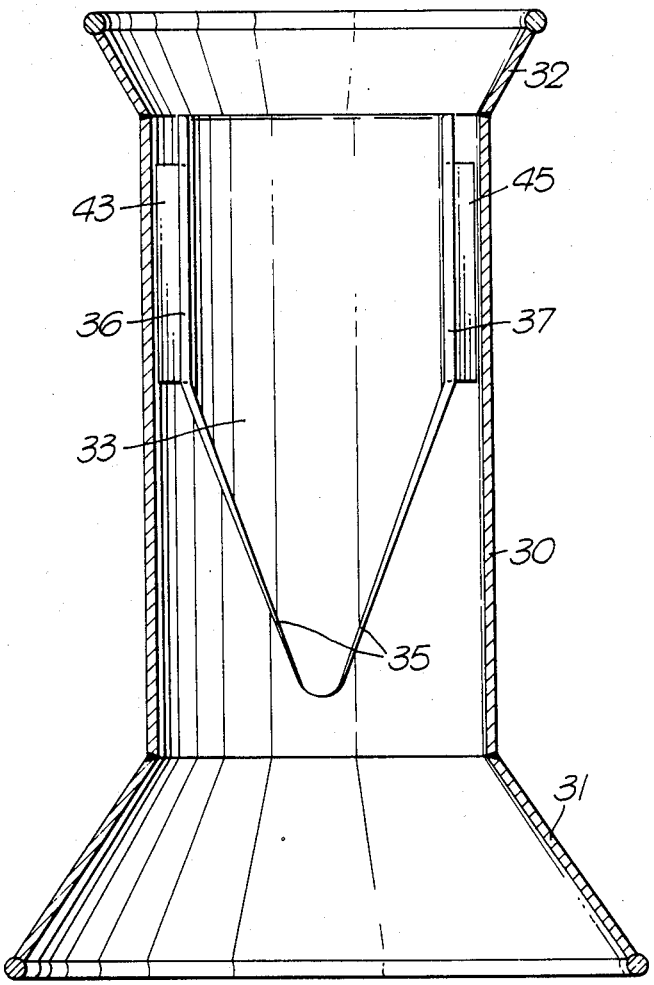
Figure 7:
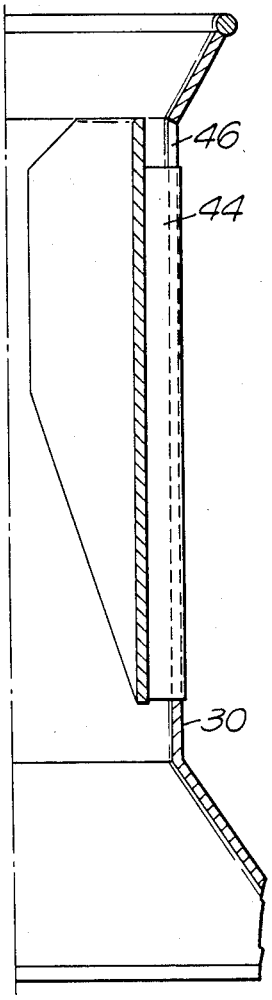
Figure 6:
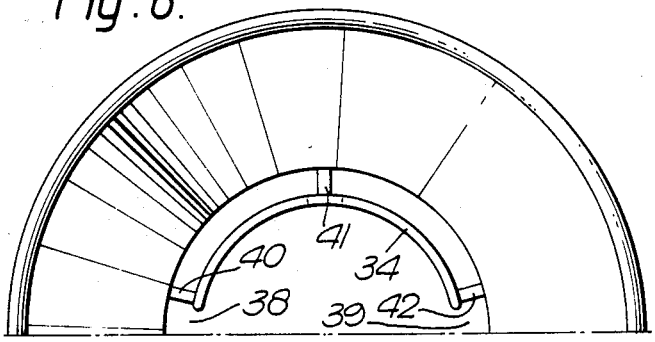
Figure 8:
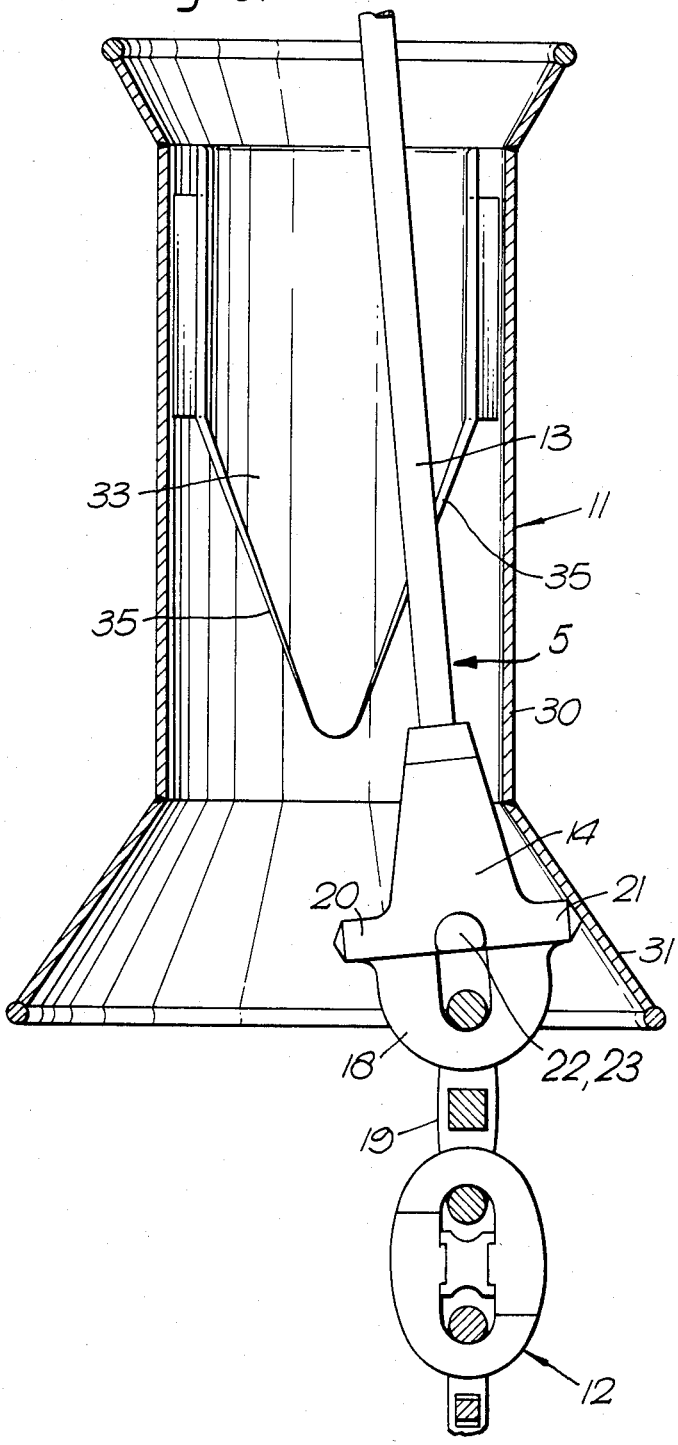
Figure 9:
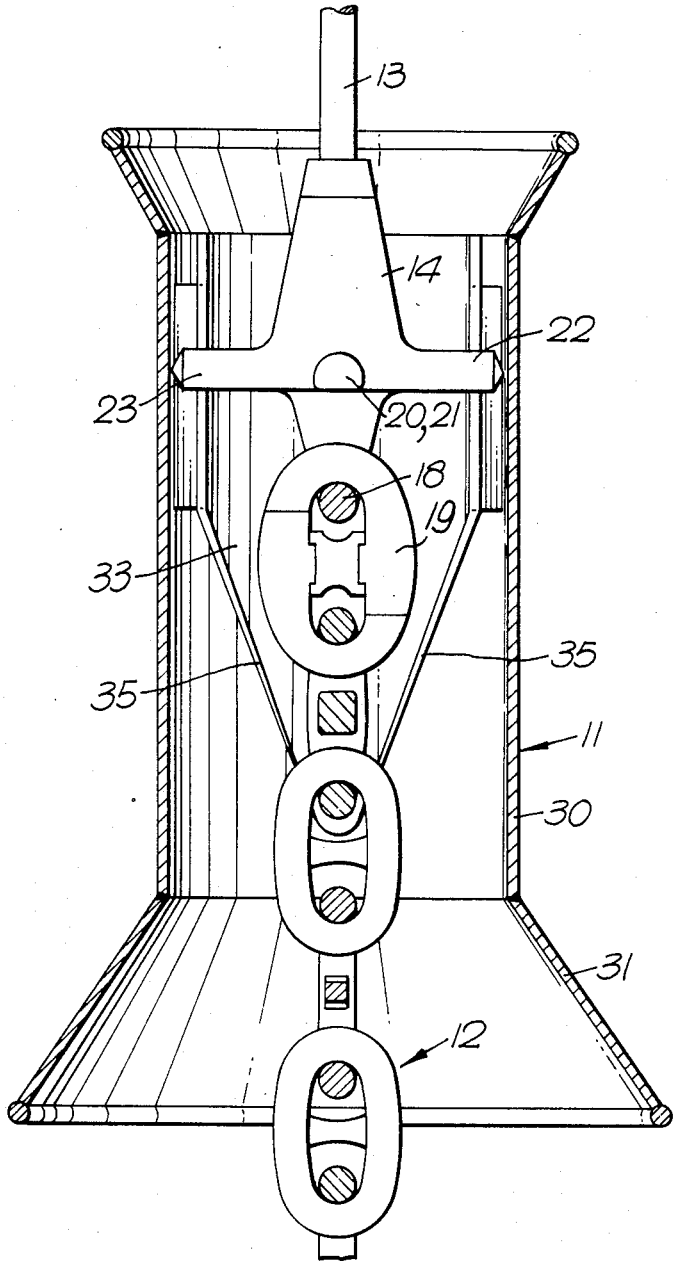

FIG. 2, is a vertical projection as in FIG. 1, with the chain part of the mooring cable drawn in over the chain sheave, FIG. 3 shows the guide sheave of FIG. 1 in cross section, as the splice member between the rope and chain passes over the sheave, FIG. 4 shows the chain sheave in cross section, as the splice member passes the chain sheave, FIG. 5 shows a hawsehole in accordance with the invention, in cross section, FIG. 6 shows one-half of the hawsehole of FIG. 5 in vertical projection, as seen from below, i.e., in the inlet direction, FIG. 7 shows one-half of the hawsehole in cross section, turned 90° in relation to the cross section in FIG. 5, FIG. 8 shows a cross section of the hawsehole as in FIG. 5, showing the splice member as it enters the hawsehole, and FIG. 9 shows the hawsehole after the splice member has been oriented and brought into the correct position in the hawsehole, now oriented for correct entry onto the succeeding chain sheave.

FIGS. 1 and 2, in vertical projection, show a platform leg 1 which forms one of the structural members of a semi-submersible offshore platform. The leg 1 extends from a pontoon 2 up to the deck 3. Pivotally mounted on the leg 1, as known per se, is a guide sheave 4 for a mooring cable 5. The guide sheave 4 is rotatably mounted about a horizontal axis in a support bracket which in turn is rotatably mounted about a vertical axis in a bracket 7 secured to the leg 1. The guide sheave 4 will be located below the waterline when the platform is moored.

A winch 8 is mounted on the platform deck 3. The winch 8 comprises a friction winch 9 and a chain winch with a chain sheave 10. Immediately preceding the chain sheave 10 (in the direction of cable travel from the anchor, which is not illustrated), there is a tubular hawsehole 11.

The mooring cable 5 is a combined rope-chain cable. The length of chain is designated by numeral 12 and the rope by numeral 13. The chain 12 and rope 13 are coupled together by means of a splice member 14.

FIG. 1 shows how the rope 13 travels over the guide sheave 4, chain sheave 10, through the friction winch 9 and down to a spooling drum 15 in the pontoon.

A chain locker 16 for the chain 12 is provided in the leg 1, and FIG. 2 shows how the rope 13 is hauled all the way in until the splice member 14 reaches the friction winch. The chain 12 travels over the guide sheave 4 and the chain sheave 10 into the chain locker 16.

The splice member 14 is guided within the hawsehole 11 in a manner which will be described below.

The splice member 14 is formed as shown in FIGS. 3 and 4. The splice member consists of a sleeve socket 17 and an integral half-link chain member 18. The rope 13 is clamped within the sleeve socket 17, and the end link 19 of the chain 12 is suspended from the half-link 18. Four pins 20, 21 and 22, 23 project from the sleeve socket 17. The pins are spaced 90° apart around the sleeve socket. The two diametrically opposed pins 20, 21 are in the same plane as the chain half-link 18, as may be seen in the drawings, whereas the other two diametrically opposed pins 22, 23 are disposed at a right angle relative to the plane of the half-link of the chain. The pins are positioned and dimensioned such that as the splice member 14 travels over the guide sheave 4, one pair of pins, in this case the pins 22, 23, will ride on the flanges 24, 25 of the guide sheave. In this manner, as is desirable, the rope 13 at the splice member is kept a necessary distance away from the groove 26 of the guide sheave, thereby preventing too much bend in the rope as it passes the guide sheave. It makes no difference in this connection which pair of pins rests against the sheave flanges.

The situation is different at the chain sheave 10. As the splice member 14 passes the chain sheave 10, it is adapted to lie within one of the pockets 27 of the chain sheave, and in this connection it must be the pair of pins 20, 21 which rides on the sheave flanges 28, 29, because only then does the end link 19 of the chain assume the vertical position which in this case is necessary. "Vertical position" should be understood to mean that the chain link is disposed in the same plane as the chain sheave, while "horizontal position" means that the chain link lies within one of the chain sheave pockets. This terminology is commonly accepted in this area of technology.

With the splice member 14 oriented as shown in FIG. 4, correct placement of the splice member and therefore correct placement of the end link 19 of the chain and the following chain links are ensured, so that the chain obtains correct engagement with the pockets in the chain sheave, between the studs on the chain sheave. To obtain this orientation, the splice member is guided into the desired position, in accordance with the invention, prior to entering the chain sheave, and in the illustrated embodiment this orientation occurs in the hawsehole shown in FIGS. 5, 6 and 7, the guidance and orientation of the splice member in the hawsehole being shown in greater detail in FIGS. 8 and 9.

The hawsehole is mounted immediately preceding the chain sheave 10 (see FIGS. 1 and 2), and is in this case formed as a tube 30 having a funnel-shaped guide 31 on the inlet side. On the outlet side, i.e., facing the chain sheave, the tube 30 has a shorter, funnel-shaped extension 32. Inside the hawsehole 11, two diametrically opposed shell plates 33, 34 extend along the wall of the hawsehole. Each shell plate has a symmetrically tapered leading edge 35 facing toward the inlet of the hawsehole. The tapered edge 35 extends from two integral, straight, longitudinal edges 36, 37. The shell plate 34 is formed in the same manner.

Each shell plate 33, 34 has an arc length which is smaller than the semicircular arc of the tube 30, and since the shells are diametrically opposed, guide grooves 38, 39 will be formed between their adjacent longitudinal edges (see FIG. 6).

Each of the shell plates 33, 34 is spaced a distance away from the wall of the hawsehole. As may be seen in FIG. 6, the shell plate 34 is connected to the hawsehole wall by means of radial spokes 40, 41 and 42; similarly, the shell plate 33 is connected to the hawsehole wall by means of radial spokes 43, 44 and 45. As shown in FIG. 7, a groove 46 is provided in the tube 30 for the center spoke 44, to provide access for welding the spoke member, and the same is provided for the diametrically opposed spoke member 41.

When the anchor cable 5 passes through the hawsehole 11, the splice member 14 will enter the hawsehole as shown in FIG. 8. The orientation of the splice member 14 about the longitudinal axis of the cable is arbitrary. In accordance with the invention, however, one of the pairs of pins is longer than the other. In this case, the pair of pins 22 and 23, which are perpendicular relative to the half-link 18, is longer than the other pair of pins 20, 21. The length of the pins 20, 21 is short enough to prevent these pins from contacting the sloping guide edges 35 on the shell plates within the hawsehole. The pins 22, 23, however, are of sufficient length to cooperate with the edges 35, thereby automatically guiding the splice member 14 into the position shown in FIG. 9. The splice member 14 is thus oriented correctly in relation to the chain sheave, causing the splice member and chain to obtain the desired correct engagement, as shown in FIG. 4. The end link of chain 19 is thereby also oriented into the shown vertical position and the chain will obtain the desired engagement with the chain sheave. As the chain passes over the chain sheave, the pins 20, 21, as shown in FIG. 4, will ride on the chain sheave flanges 28, 29, and the one pin 23 of the other pair of pins will pass between the studs on the chain sheave.

Having described our invention, we claim:

1. An assembly on a chain sheave/chain-rope system wherein an end of a chain is connected to an end of a rope in a splice member adapted to travel over a chain sheave with opposing sheave flanges by lying within a recess or pocket of the sheave formed by chain engaging studs, the splice member comprising a sleeve socket for receiving the rope end and a half-link of chain, from which the end link of the chain is suspended, characterized by guide members on the splice member which cooperate with guide members in a hawsehole preceding the chain sheave, by means of which the end link of the chain is brought into the correct postion for engagement prior to entering the chain sheave, the splice member having four protruding pins spaced 90° apart around the sleeve socket, two diametrically opposed pins being disposed in the same plane as the half-link of chain, the assembly being so constructed that during passage of the splice member about a chain sheave, one pair of diametrically opposed pins will ride on the sheave flanges whereas one pin of the other pair of pins passes into the groove between studs of the chain sheave, the sleeve socket thus lying within a pocket of the chain sheave, the pins in one of the pairs being longer than the pins in the other pair and the longer pins acting as said guide members.

2. An assembly on a chain sheave/chain-rope system wherein an end of a chain is connected to an end of a rope in a splice member adapted to travel over a chain sheave by lying within a recess or pocket of the sheave, the splice member comprising a sleeve socket for receiving the rope end and a half-link of chain, from which the end link of the chain is suspended, characterized by guide members on the splice member which cooperate with guide members in a hawsehole preceding the chain sheave, by means of which the end link of the chain is brought into the correct position for engagement prior to entering the chain sheave, the guide member being arranged within the hawsehole for cooperation with guide members disposed on the splice member, such that the end link of the chain, which hangs from the chain half-link disposed on the splice member, is brought into the correct position for engagement prior to the chain's entry onto the chain sheave, said guide members being in the form of two diametrically opposed grooves extending along the interior walls of the hawsehole in the direction of cable passage, with guide ramps leading up to the respective guide grooves.

3. A hawsehole according to claim 2, characterized in that it is tubular in shape and has a funnel-shaped guide at the inlet end thereof.

4. A hawsehole according to claim 3, characterized by two diametrically opposed shell plates disposed within the hawsehole and extending along walls thereof, each having a symmetrically tapered leading edge facing toward the hawsehole inlet and two straight longitudinal edges, wherein each shell plate has an arc length which is smaller than a semicircle.

5. A hawsehole according to claim 4, characterized in that the shell plates are spaced a distance away from the surrounding wall of the hawsehole and are connected to the wall by radial spokes.

* * * * *